US005269514A

United States Patent [19]

Adler et al.

[11] Patent Number: 5,269,514

[45] Date of Patent: Dec. 14, 1993

[54] FOOTBALL WITH FINS

[76] Inventors: Alan J. Adler, 752 La Para Ave., Palo Alto, Calif. 94306; Brendan J. Boyle, 937 Lincoln Ave., Palo Alto, Calif. 94301; Fern Mandelbaum, 535 Morey Dr., Menlo Park, Calif. 94025

[21] Appl. No.: 900,622

[22] Filed: Jun. 18, 1992

[51] Int. Cl.[5] ..... A63B 43/02

[52] U.S. Cl. ..... 273/65 EE; 273/65 EF; 273/65 EG; 273/DIG. 20; 273/58 K

[58] Field of Search ..... 273/65 EF, 65 EE, 65 EG, 273/20, 65 ED, 65 R, 65 E, 58 A, 58 K

[56] References Cited

U.S. PATENT DOCUMENTS

| | | | |
|---|---|---|---|
| Re. 33,449 | 11/1990 | Martin | 273/65 EE |
| D. 322,105 | 12/1991 | Ma | D21/205 |
| 3,225,488 | 12/1965 | Goldfarb | 273/65 EF |
| 3,256,020 | 6/1966 | Smith | 273/65 |
| 3,604,352 | 9/1971 | Bench | 102/4 |
| 4,736,948 | 4/1988 | Thomas | 273/65 EF |
| 4,772,020 | 9/1988 | Martin | 273/65 EE |
| 4,887,814 | 12/1989 | Winter | 273/65 EE |
| 4,919,422 | 4/1990 | Ma | 273/26 R |
| 5,133,550 | 7/1992 | Handy | 273/65 EE |

OTHER PUBLICATIONS

Shevell, Richard S., *Fundamentals of Flight*, 2d. ed., Prentice Hall, Inc., Englewood Cliffs, 1989, pp. 309, 312.

Schlichting et al., *Aerodynamics of the Airplane*, McGrall-Hill International Book Company, New York, 1979, pp. 137-166.

Clancy, L. J., *Aerodynamics*, Halsted Press, New York, 1975, pp. 489-490.

*Primary Examiner*—George J. Marlo

*Attorney, Agent, or Firm*—Townsend and Townsend Khourie and Crew

[57] ABSTRACT

A ball of prolate (football-shaped) configuration having external fins oriented at an angle relative to the longitudinal axis to promote rotation in flight and having leading and trailing edges positioned such that the net center of aerodynamic lift of said fins is located rearwardly of the ball's longitudinal midpoint.

15 Claims, 6 Drawing Sheets

FOOTBALL WITH FINS

BACKGROUND OF THE INVENTION

The present invention relates to balls, footballs, and other hand-thrown projectiles.

It is well-known that the proper way to achieve stable and accurate flight of a football is to impart rotation to it during launch. Many individuals find this difficult to achieve. Two prior footballs have been patented which include fins intended to impart rotation. These devices are discussed briefly below.

Thomas, U.S. Pat. No. 4,736,948, discloses an inflated football with a longitudinal central passageway containing angled internal fins. The present inventors have found that internal fins produce limited rotational torque due to two important factors. First, the fins are close to the center and thus have a short lever arm to impart torque upon the axis of rotation. Second, the air velocity through the central passageway is retarded by the friction and boundary layer of the passageway walls. Thus the fins' aerodynamic force, which is proportional to air velocity squared, is retarded.

Goldfarb, U.S. Pat. No. 3,225,488 discloses an inflatable football with four external tail fins. However Goldfarb oriented three of his four fins straight ahead so that they strongly resist the small amount rotational torque imparted by his slightly-angled fourth fin. Indeed, it has been determined that Goldfarb's football will not spin as well as an ordinary un-finned football.

There have also been footballs patented with spiral grooves or ridges to assist throwing. Some of these patents also state that the grooves or ridges impart rotation. Several of these balls have been tested by launching them free of initial rotation. None developed rotation in flight.

SUMMARY OF THE INVENTION

In contrast to the prior art, the football of the present invention rotates eagerly in flight due to its greatly improved aerodynamic design. In brief, the present invention comprises a football or elongated body with a plurality of external angled fins. The ball rotates readily in flight due to the aerodynamic action of its fins.

Each fin is configured to provide aerodynamic action (lift) that results in a torque about the body's longitudinal axis as the football moves through the air. The fins are typically disposed symmetrically and in a manner that their respective torques add but the net force (or net lift) is zero.

It has been found that the fins promote rotation when the helical pitch angle is at least 15° for at least one radial distance from the axis. The helical pitch angle at a given radial distance from the axis is defined as the angle between the chord line at the given radial distance and a reference plane defined by the axis and a construction line that is parallel to the axis and intersects the chord line at the leading edge of the fin.

A further understanding of the nature and advantages of the present invention can be realized by reference to the remaining portions of the specification and the drawings.

DESCRIPTION OF THE SPECIFIC EMBODIMENTS

Figure 1A:
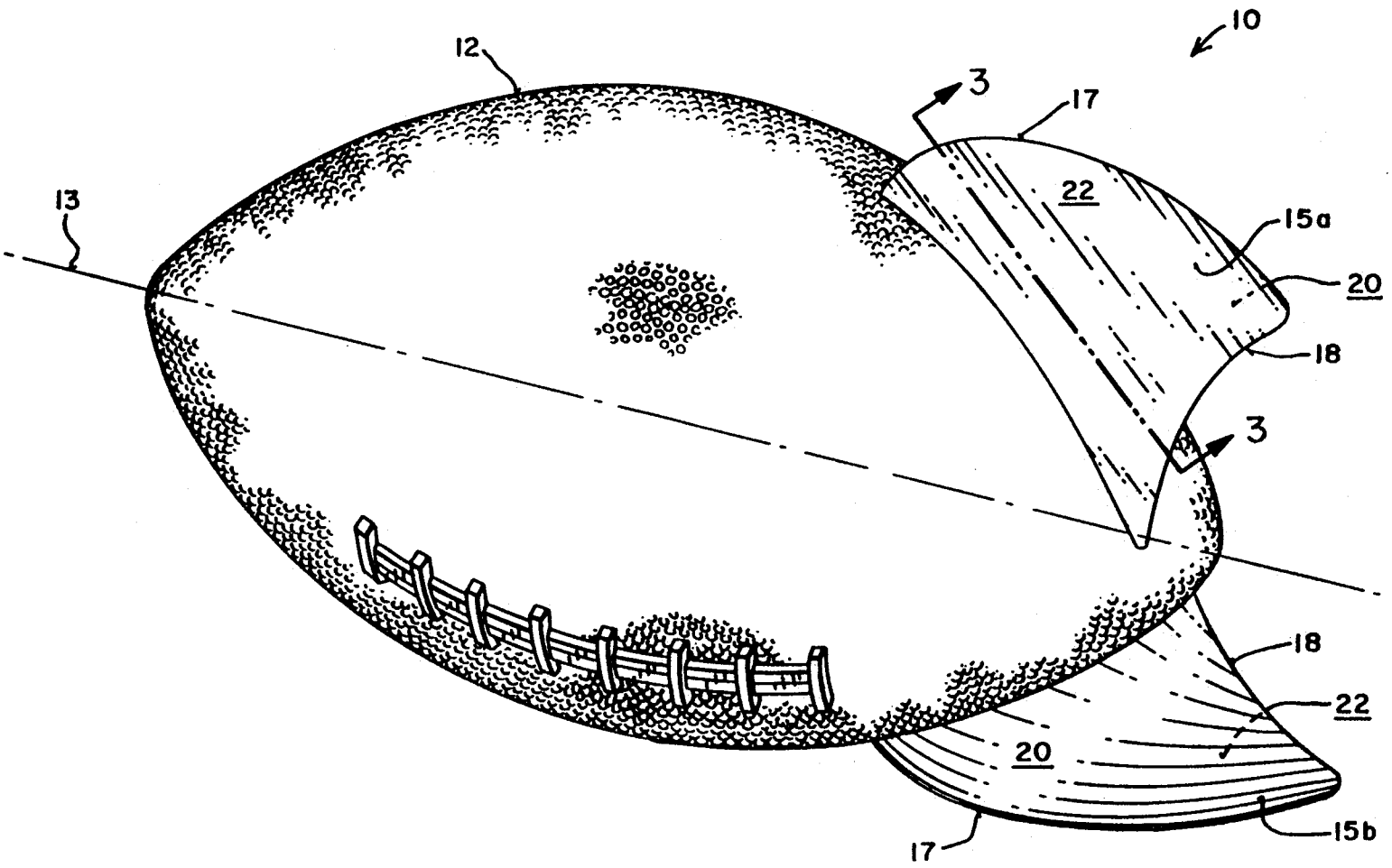
FIG. 1A is a perspective view of a finned football according to the present invention.

FIG. 1A is a perspective view illustrating a finned football 10 according to the present invention. The football comprises a body 12 of generally prolate (football-shaped) configuration, symmetrical about a longitudinal axis of rotation 13. A pair of fins 15*a* and 15*b* are mounted on opposite sides of the body and extend radially outwardly from the body. Each fin has a leading edge 17 and a trailing edge 18. The football, as illustrated, is configured for a right-handed thrower and thus, the fins are configured to promote clockwise rotation.

Each of the fins is configured as an airfoil. The airfoils are oriented oppositely so that the lift provided by one is opposite to that provided by the other. Thus, each fin exerts torque and the torques add to cause rotation (but not net lift). Accordingly, each fin is defined to have an upper surface 20 and a lower surface 22, with the understanding that the upper surface represents the direction of the lift. When the fins are generally horizontal, the upper surface of one fin will in fact be below the lower surface of that fin, and when the fins are vertically oriented, the upper and lower surfaces of each fin will both be generally vertical.

Figure 1B:
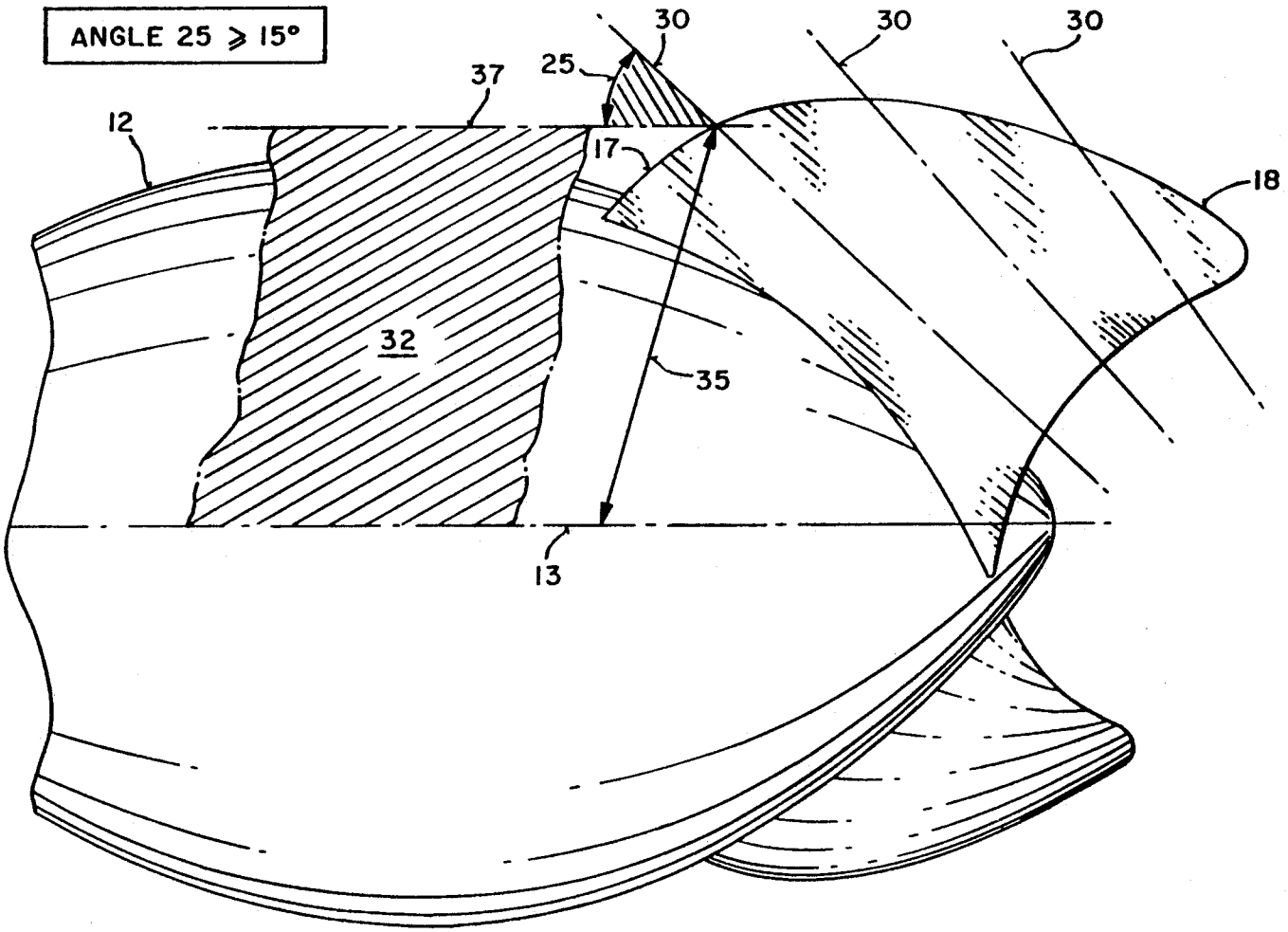
FIG. 1B is an enlarged perspective view showing one of the fins.
Figure 2A:
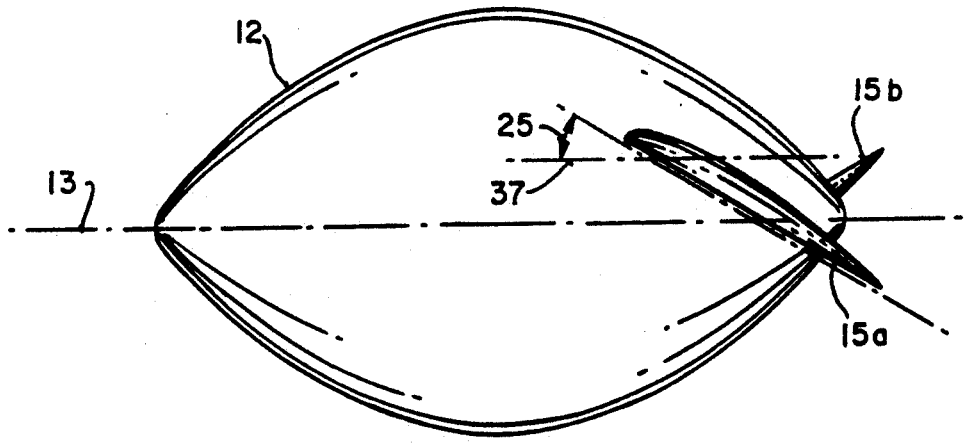
FIGS. 2A–C are side elevational, rear elevational, and top plan views of the football.
Figure 2B:
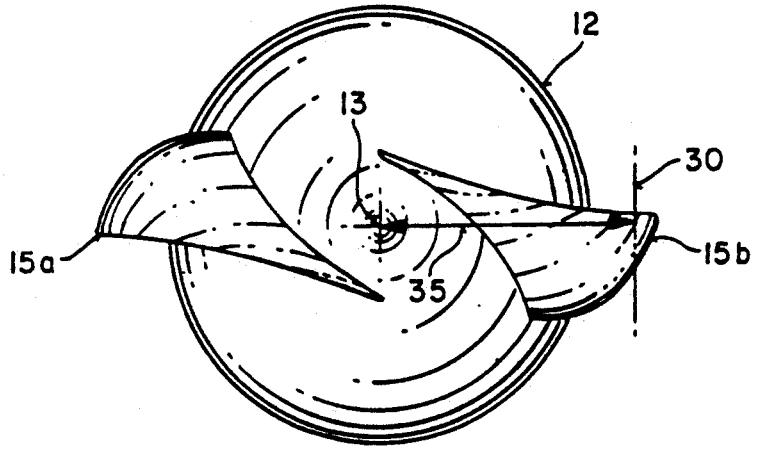
Figure 2C:
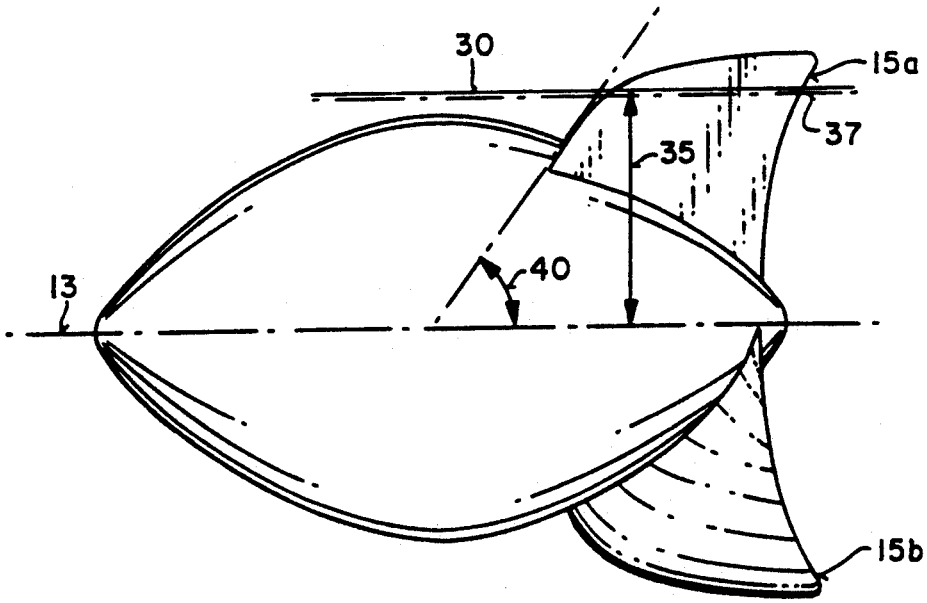

FIG. 1B is an enlarged perspective view of football 10, illustrating fin 15*a* and a number of reference lines and planes that characterize the geometry. FIGS. 2A–C are side elevational, rear elevational, and top plan views of the football, further illustrating the geometry. Each fin is oriented to form a helical pitch angle 25 defined between a chord line 30 and a reference plane 32. Each chord line is drawn to pass through the leading and trailing edges at a given radial distance 35 from the longitudinal axis. A construction line 37 is parallel to the axis and intersects a given chord line at the leading edge. Construction line 37 and longitudinal axis 13 define a reference plane 32, and the helical pitch angle is defined as the angle between the chord line and reference plane 32. The helical pitch angle is measured by an arc of measurement, the plane of which is perpendicular to the reference plane and parallel to the longitudinal axis.

The helical pitch angle 25 should be at least 15° for at least one radial distance 35. Smaller helical pitch angles can retard rotation to a rate lower than that possible with an un-finned ball. For any given radial distance from the longitudinal axis, the helical pitch angle should also be substantially identical for every fin having like longitudinal location on the body.

In an alternative embodiment, each fin is twisted such that the helical pitch angle increases with increasing radial distance from the longitudinal axis. In some cases twisting the fins this way permits an optimum angle of attack in the airflow to be maintained over a greater percentage of fin span. This is because the angle of the airflow over the fins is proportional to the circumferential velocity of the fin at any given radial distance. As the radial distance increases, so does the circumferential velocity and thus the angle of the airflow. However it is still desirable that at any given radial distance, the helical pitch angles be identical for all fins of similar longitudinal location on the body.

Each fin is further characterized by a leading edge angle 40, defined as the angle between the leading edge of the fin and the longitudinal axis (see FIG. 2C). At least a portion of the leading edge angle should be at least 20° in order to intercept the airflow and produce adequate force.

It is desirable that fins 15*a* and 15*b* extend radially beyond the maximum diameter of body 12. The present inventors have discovered that this improves spin. This is believed to be due to two factors. First, the velocity of air flow close to the body of the ball, especially aft of the maximum diameter, is retarded by the frictional boundary layer, and the wake of the ball body. Extending the fins radially beyond the ball body allows them to function in higher velocity flow, and thus produce higher force. Second, extending the fins radially beyond the ball body increases the "lever arm" between the fin center of force and the ball center of rotation. Thus a given force develops greater torque.

As mentioned above, at least some part of each fin should have a helical pitch angle of at least 15°. For the reasons discussed above in connection with the radial extent of the fins, the portions of the fin nearest the body do not contribute as greatly to the desired torque. Therefore, it is possible to have the fins with helical pitch angles less than 15° near the body if other considerations so dictate.

The invention may be constructed either as an inflated football, or molded of soft elastomeric cellular foam material. In either case, the body with fins may be molded of a single monolithic material, or the fins may be first molded and then insert-molded to the body. For insert-molding, the previously-molded fins are inserted into the body mold and the body material is then molded to join with the roots of the fins. This permits the option of making the fins and body of different materials. For example, rubber fins could be insert-molded to a foam body. In another example, rubber or vinyl fins could be inserted into a rotational mold and insert-molded to an inflated vinyl body.

FIGS. 3A-3E show several alternative cross-sections of the fins taken at section line 3—3 in FIG. 1A. The airfoil section is characterized by a leading edge radius 45 and a maximum thickness 47. Another desirable feature of the present invention is that leading edge radius 45 of each fin should be no more than one quarter of the maximum thickness 47 of the fin when measured at any given chord line. Such relatively sharp leading edge radii have been found to produce greater aerodynamic force and efficiency than fins of larger leading edge radii.

Figure 3A:
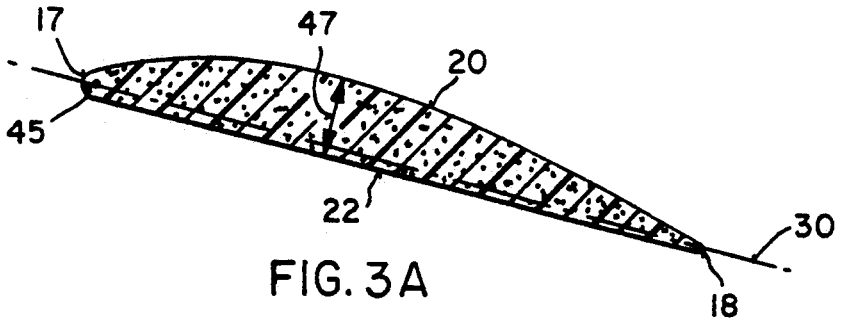
FIGS. 3A–E are cross-sections of various embodiments of the fins.
Figure 3B:
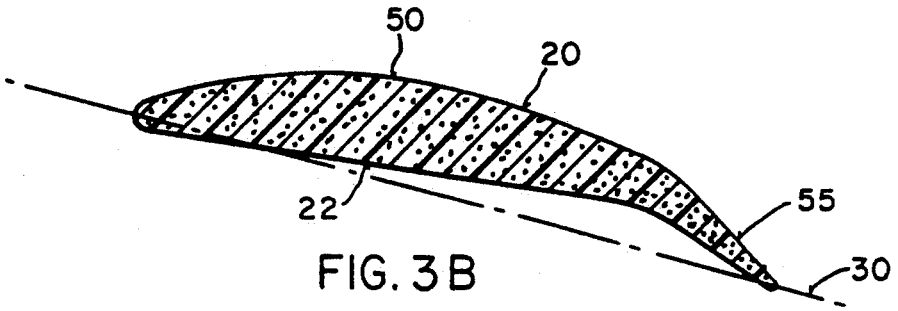
Figure 3C:
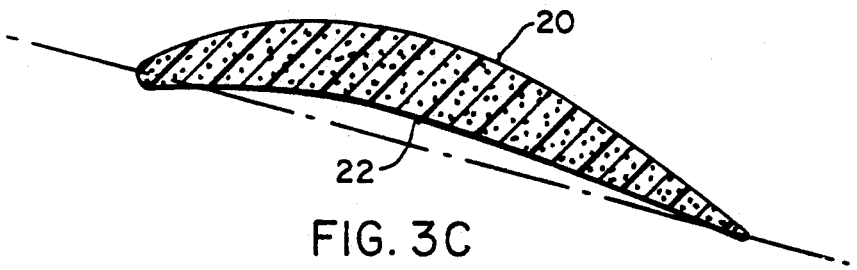
Figure 3D:
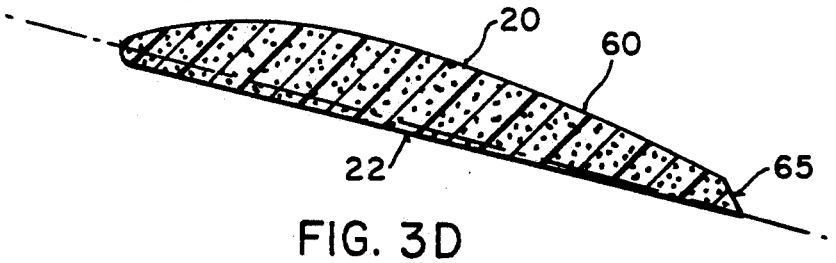
Figure 3E:
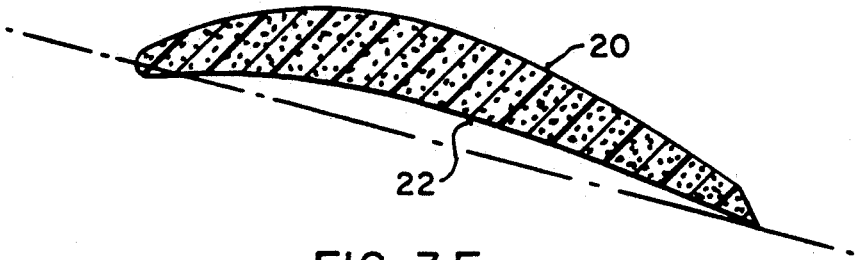

FIG. 3A shows a fin having a cross-section with a convex upper surface and a substantially flat lower surface. FIG. 3B shows a fin similar to that of FIG. 3A but having a main portion 50 and a downwardly depending flap 55 at the trailing end of the main portion so that the flap's trailing edge defines the fin's trailing edge. FIG. 3C shows a fin having a cross-section with a convex upper surface and a concave lower surface. FIG. 3D shows a fin having a cross-section with a convex upper surface main portion 60, a relatively thick trailing edge, a sloped rear surface 65, and a flat lower surface. FIG. 3E shows a fin similar to that of FIG. 3D but with a concave lower surface.

The cross-sections of FIGS. 3D and 3E are the subject of a separate co-pending patent application. These sections are especially suited to construction in soft materials and thus, are preferred for versions of the present invention comprising fins constructed of soft material. If the fins are made of a soft material such as foam, it is best that each of the fins be stiffened by making it thickest at the fin root and then tapered to lesser thickness as the radial distance 35 from the longitudinal axis of rotation increases. This helps maintain the desired orientation of the fins in flight.

For purposes of this disclosure, the curvature of a fin surface is defined as being "greater" when a central portion of the fin surface curves farther away from the opposite surface (as in the case of all depicted alternative upper surfaces 20) and "lesser" when a central portion of the fin surface curves less far from the opposite surface (as is the case of all depicted alternative lower surfaces 22). A desirable feature of the present invention is that the fins have a cross-section comprising an upper surface of greater degree of curvature than the lower surface. Such sections have been found to produce greater aerodynamic force and efficiency than fins lacking this feature.

By way of example, the invention may be constructed as a small ball with a longitudinal axis of 8.5 inches in length and a maximum body diameter of 5 inches. Two fins are attached to the rear portion of the body. Each fin has a helical pitch angle of 30 degrees and is oriented for clockwise rotation—which is preferred for right-handed throwers. The tips of each fin extend to a maximum radial distance which is one inch beyond the maximum diameter of the body.

The invention may be constructed of elastomeric cellular foam material with a weight of approximately 160 grams or it may be inflated rubber or vinyl with the same or somewhat greater weight. In addition both smaller balls and larger balls are envisioned.

Figure 4:
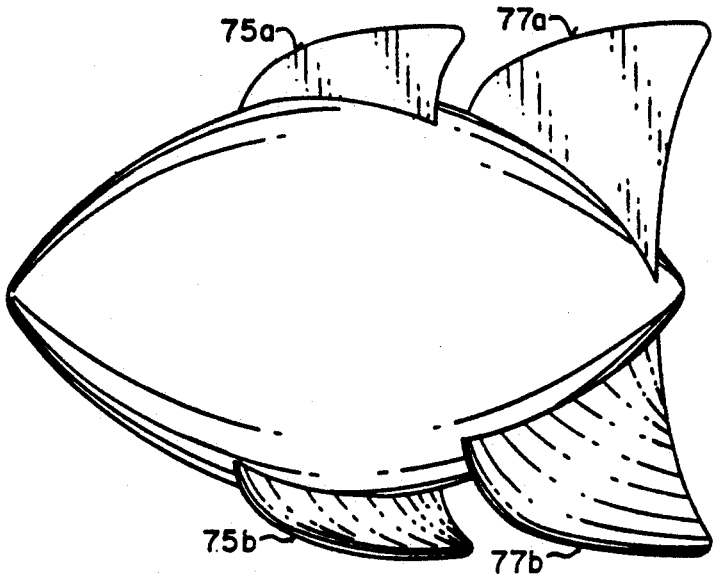
FIG. 4 is a top plan view showing an alternative design having tandem fins.

FIG. 4 shows an alternative embodiment with tandem fins, namely forward fins 75*a* and 75*b* and rear fins 77*a* and 77*b*. In this embodiment the forward fins contact the region of maximum diameter of the body. The forward fins produce good rotational torque despite being relatively small because they are located at a point of maximum body diameter. At this forward location the boundary layer of stagnant airflow around the body is thinner and the fins are positioned with longer lever arms to exert rotational torque. However, if tandem fins are employed, it is still important that at any given radial distance 35, the helical pitch angle 25 be identical for all fins of like longitudinal location.

Figure 5A:
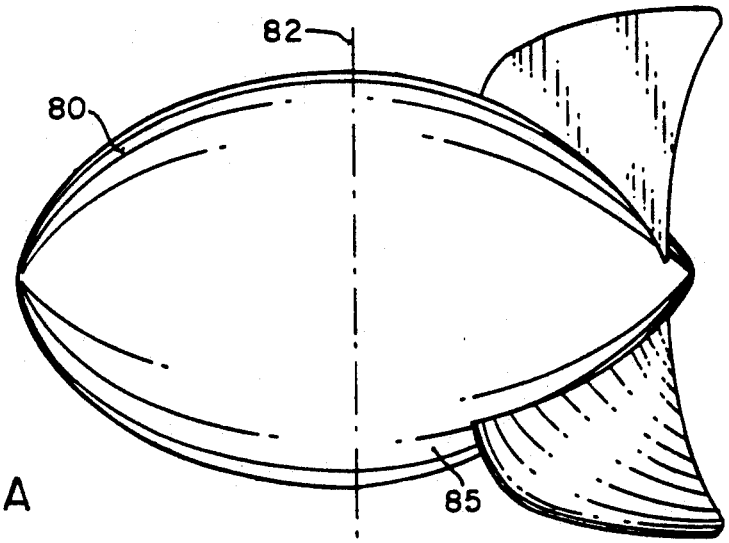
FIGS. 5A and 5B are top plan views illustrating alternative body designs.
Figure 5B:
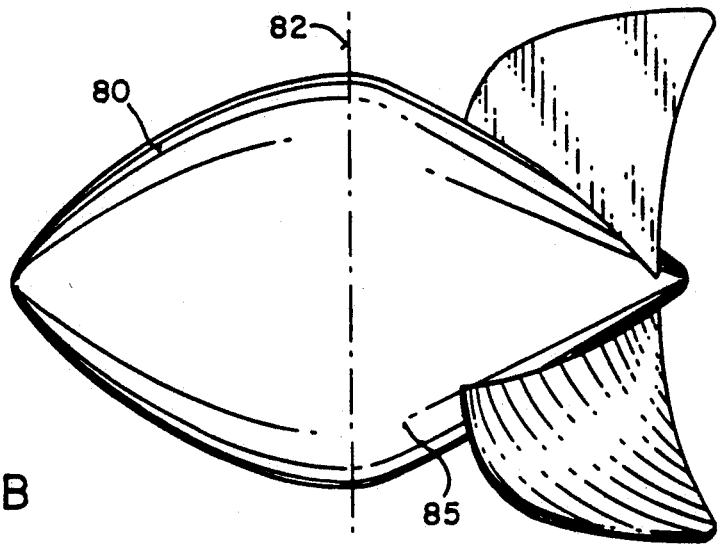

FIGS. 5A and 5B show alternative body designs. Each of these alternative bodies is longitudinally asymmetrical such that the portion 80 of the body forward of the longitudinal midpoint 82 is fuller and of greater volume than the portion 85 of the body aft of the longitudinal midpoint. Such a body can have lower aerodynamic drag than the symmetrical body of FIGS. 1A-B and 2A-C.

The location of the net center of aerodynamic lift of the fins may be calculated by standard aerodynamic methods and is well known to be approximately 25% of the longitudinal distance from the leading edge to the trailing edge of the fin. Such calculations are taught in numerous aerodynamic texts.

As evidenced by the drawings, the leading and trailing edges of the fins are longitudinally positioned such that the net center of aerodynamic lift of the fins is located aft of the longitudinal midpoint of the football in order to promote stability in flight. This is true for all embodiments of the invention including the tandem fin configuration of FIG. 4.

Figure 6A:
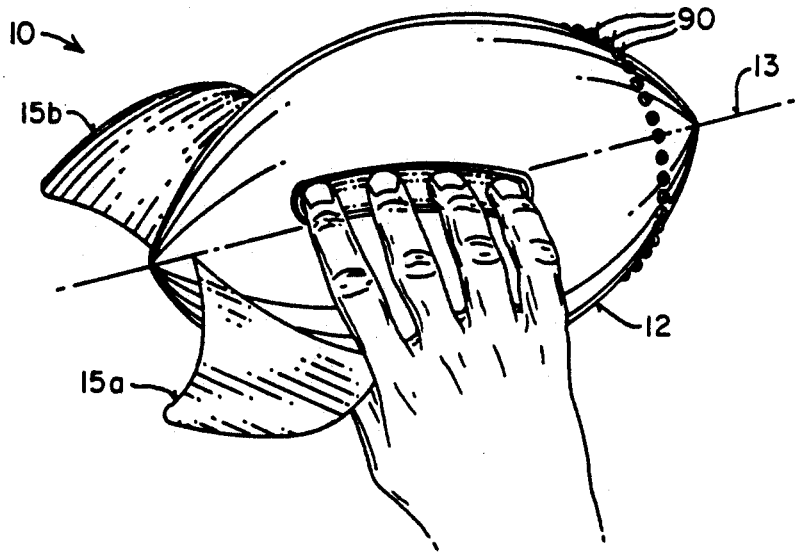
FIGS. 6A–C illustrate possible surface features of the football.
Figure 6B:
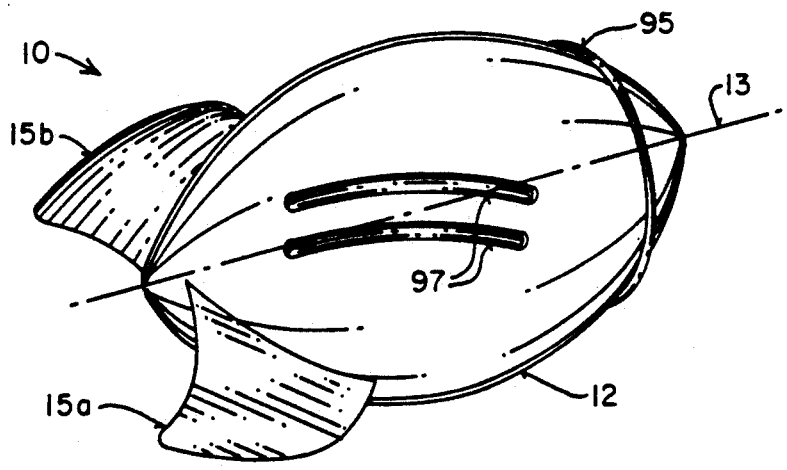
Figure 6C:
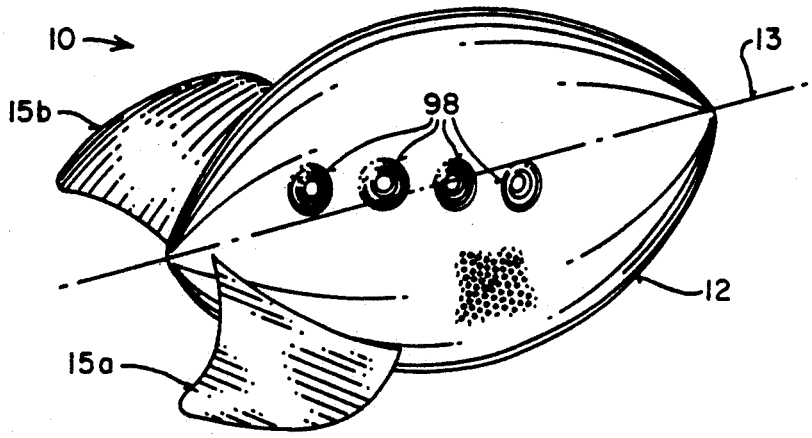

The football body is preferably textured to promote turbulent airflow and improve grip. A number of additional (or alternative) techniques may be used to these same ends. For example, FIG. 6A shows a football where the forward portion of the surface of the body is configured with one or more turbulence-stimulating protuberances in the form of one or more bumps 90 and the mid and aft portions of the body are formed with longitudinally extending grooves 92 (only one of which is shown) to assist the thrower in imparting rotation during launch. Similarly, FIG. 6B shows a football having a protuberance in the form of a circumferential ridge 95 for providing turbulence and a number of ridges 97 for improving grip. Similarly, FIG. 6C shows a football having a textured surface for turbulence and a number of indentations 98 for gripping.

In use the football of the present invention is quite easy to throw and the rotation imparted by the fins stabilizes the flight and provides satisfying visual feedback to the users.

While in foregoing specification describes the invention in detail in order to make a full disclosure, it will be understood that variations or modifications are possible without departing from the spirit and scope of the invention as described in this specification and the following claims.

What is claimed is:

1. A football comprising a body of generally prolate configuration, characterized by a longitudinal axis of rotation and a longitudinal midpoint, and a plurality of fins extending radially outward from said body, wherein:

each of said fins is configured to create significant lift as the football moves longitudinally when thrown;

each of said fins has a leading edge and a trailing edge and is oriented to form a helical pitch angle relative to a reference plane extending radially from said longitudinal axis of rotation so as to exert a net torque about said longitudinal axis to promote rotation thereabout;

at any given radial distance from said longitudinal axis said helical pitch angle is substantially identical for every fin having like longitudinal location on said body and said helical pitch angle is at least fifteen degrees for at least one radial distance from said longitudinal axis of rotation; and said leading and trailing edges of said fins are longitudinally positioned such that the net center of aerodynamic lift of said fins is located rearward of said longitudinal midpoint to promote stability in flight.

2. The football of claim 1 wherein said fins have a cross-section comprising an upper surface and a lower surface wherein said upper surface has a greater degree of curvature than said lower surface.

3. The football of claim 1 wherein said fins extend radially beyond the maximum diameter of said body.

4. The football of claim 1 wherein the leading edge of each of said fins forms an angle relative to said longitudinal axis of greater than twenty degrees.

5. The football of claim 1 wherein said fins are twisted such that said helical pitch angles of said chord lines increase with increasing radial distance from said longitudinal axis of rotation.

6. The football of claim 1 comprising exactly two fins.

7. The football of claim 1 wherein each of said fins has a leading edge radius of less than one quarter the maximum thickness of said fin when measured on any given chord line.

8. The football of claim 1 wherein a portion of the surface of said body forward of said longitudinal midpoint is configured with one or more turbulence-stimulating protuberances.

9. The football of claim 1 wherein said body has one or more grooves or indentations configured to engage the finger tips to assist the thrower to impart rotation during launch.

10. The football of claim 1 wherein said body has one or more ridges configured to engage the finger tips to assist the thrower to impart rotation during launch.

11. The football of claim 1 manufactured from elastomeric cellular foam material.

12. The football of claim 1 wherein the surface of said body is textured to promote turbulent airflow and improve grip.

13. The football of claim 1 wherein the contour of said body is longitudinally asymmetrical such that the portion of said body forward of said longitudinal midpoint is fuller and of greater volume than the portion of said body rearward of said longitudinal midpoint.

14. The football of claim 1 wherein:

said body is characterized by a region of maximum diameter; and some of said fins contact said region of maximum diameter.

15. The football of claim 1 wherein said fins and said body are formed monolithically.

* * * * *